US005729815A

United States Patent [19]

Lindblad et al.

[11] Patent Number: 5,729,815

[45] Date of Patent: Mar. 17, 1998

[54] CORRECT BRUSH BIAS POLARITY FOR SINGLE AND DUAL ESB CLEANERS WITH TRIBOELECTRIC NEGATIVE TONERS

[75] Inventors: Nero R. Lindblad, Ontario; Christopher W. Curry; Darryl L. Pozzanghera, both of Rochester, all of N.Y.

[73] Assignee: Xerox Corporation, Stamford, Conn.

[21] Appl. No.: 622,978

[22] Filed: Mar. 27, 1996

[51] Int. Cl.[6] ..... G03G 21/00

[52] U.S. Cl. ..... 399/354; 399/349

[58] Field of Search ..... 355/301, 303, 355/302, 296, 297, 298; 399/349, 343, 123, 353, 354, 129

[56] References Cited

U.S. PATENT DOCUMENTS 4,545,669 10/1985 Hays et al. ..... 355/3 R 5,257,079 10/1993 Lange et al. ..... 355/303

FOREIGN PATENT DOCUMENTS 06-130875 5/1994 Japan .

OTHER PUBLICATIONS

Translation of 06–130875.

*Primary Examiner*—Joan H. Pendegrass
*Assistant Examiner*—Quana Grainger
*Attorney, Agent, or Firm*—T. L. Fair

[57] ABSTRACT

An apparatus and method for cleaning charged triboelectric negative toner residual particles from the photoreceptor surface. A positive bias is applied to two electrostatic brushes in the dual cleaning system or to a single electrostatic brush. The rotational speed of the single positive brush is increased, over that of the individual brushes in a dual brush cleaner, to clean charged triboelectric negative toner particles.

10 Claims, 4 Drawing Sheets

CORRECT BRUSH BIAS POLARITY FOR SINGLE AND DUAL ESB CLEANERS WITH TRIBOELECTRIC NEGATIVE TONERS

CROSS REFERENCE

Cross reference is made to and priority is claimed from U.S. patent application Ser. No. 08/622,980, entitled "Brush Bias Polarity for Dual ESB Cleaners Without Preclean Corotron for Triboelectric Negative Toners" by N. R. Lindblad et al., assigned to the same assignee as the present invention.

BACKGROUND OF THE INVENTION

This invention relates to an electrostatographic printer or copier, and more particularly concerns a cleaning apparatus for removing triboelectric negative toner from an imaging surface.

With greater use of triboelectrically negative toner in printer and copier machines, a more efficient way to remove these toner particles from the imaging surface is needed.

The following disclosures may be relevant to various aspects of the present invention and may be briefly summarized as follows:

U.S. Pat. No. 5,257,079 to Lange et al. discloses a cleaning brush electrically biased with an alternating current removes discharged particles from an imaging surface. The particles on the imaging surface are discharged by a corona generating device. A second cleaning device including an insulative brush, a conductive brush or a blade, located upstream of the first mentioned brush, in the direction of movement of the imaging surface, further removes redeposited particles therefrom.

U.S. Pat. No. 4,545,669 to Hays et al. discloses an apparatus for simultaneously charging, exposing, and developing imaging numbers at low voltages which comprises a semi-transparent deflected flexible imaging member, an electronic imaging source means, a light beam deflector member, a means, containing magnets therein, a development roll means containing magnets therein, a voltage source means for sensitizing roll means, a voltage source for the development roll means, a developer supply reservoir containing conductive developer particles therein comprised of insulating toner resin particles and conductive carrier particles, a sensitizing nip situated between the flexible imaging member and the sensitizing roll, a development nip situated between the imaging member and the development roller, the sensitizing roll means and development roll means moving in the same direction of movement as the semi-transparent deflected flexible imaging member, the voltage being generated by the voltage source with the sensitizing nip being of an opposite polarity of the voltage generated by the voltage source for the development roller, wherein an electric field of a predetermined polarity is established between the semi-transparent deflected flexible imaging member and the sensitizing roll means, which field exert in the sensitizing roll means, which field exerts in the sensitizing nip an electrostatic force on the charged toner particles causing these particles to uniformly migrate toward the imaging member, subsequently subjecting the deflected flexible imaging member to the electronic image source whereby the electrostatic force exerted on the toner particles adjacent the light struck areas of the flexible imaging member are increased thereby causing toner particles to be deposited on the deflected flexible imaging member, and wherein toner particles are removed from the deflected flexible imaging member in areas not exposed to light by the development roll and developed in the areas exposed to light.

SUMMARY OF INVENTION

Briefly stated, and in accordance with one aspect of the present invention, there is provided an apparatus for removing charged triboelectric negative particles from a surface, the surface being capable of movement, comprising: a preclean corotron having a first bias; and a first means of cleaning the charged triboelectric negative particles from the surface, having a second bias different from the first bias of the preclean corotron.

Pursuant to another aspect of the present invention, a method for cleaning charged triboelectric negative particles from a surface, comprising: transferring an image to a print medium; precleaning the particles remaining after transfer, on the surface, using a negatively charged corotron; charging a first brush positively to remove both the charged triboelectric negative particles having negative charge and the charged triboelectric negative particles having positive charge that remain on the surface after transfer as the first brush contacts the surface.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

For a general understanding of a color electrostatographic printing or copying machine in which the present invention may be incorporated, reference is made to U.S. Pat. Nos. 4,599,285 and 4,679,929, whose contents are herein incorporated by reference, which describe the image on image process having multi-pass development with single pass transfer. Although the cleaning method and apparatus of the present invention is particularly well adapted for use in a color electrostatographic printing or copying machine, it should become evident from the following discussion, that it is equally well suited for use in a wide variety of devices and is not necessarily limited to the particular embodiments shown herein.

Figure 4:
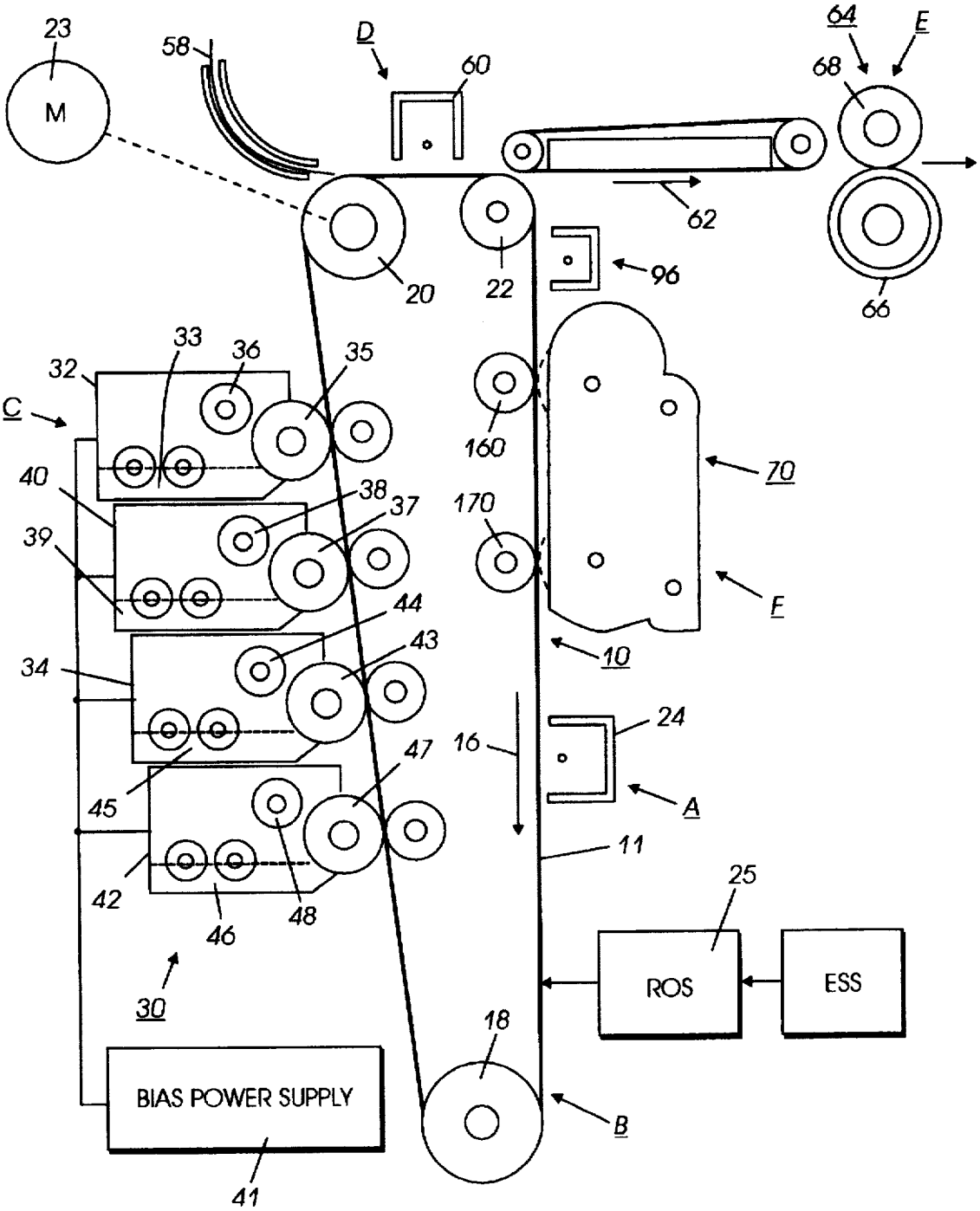
FIG. 4 is a schematic illustration of a printing apparatus incorporating the inventive features of the present invention.

Referring now to the drawings, where the showings are for the purpose of describing a preferred embodiment of the invention and not for limiting same, the various processing stations employed in the reproduction machine illustrated in FIG. 4 will be briefly described.

A reproduction machine, from which the present invention finds advantageous use, utilizes a charge retentive member in the form of the photoconductive belt 10 consisting of a photoconductive surface and an electrically conductive, light transmissive substrate mounted for movement pass charging station A, and exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 18 to advance belt 10 in the direction of arrow 16. Roller 20 is coupled to motor 23 by suitable means such as a belt drive.

As can be seen by further reference to FIG. 4, initially successive portions of belt 10 pass through charging station A. At charging station A, a corona device such as a scorotron, corotron or dicorotron indicated generally by the reference numeral 24, charges the belt 10 to a selectively high uniform positive or negative potential. Any suitable control, well known in the art, may be employed for controlling the corona device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device (for example a two level Raster Output Scanner (ROS)).

The photoreceptor, which is initially charged to a voltage, undergoes dark decay to a voltage level. When exposed at the exposure station B it is discharged to near zero or ground potential for the image area in all colors.

At development station C, a development system, indicated generally by the reference numeral 30, advances development materials into contact with the electrostatic latent images. The development system 30 comprises first 42, second 40, third 34 and fourth 32 developer apparatuses. (However, this number may increase or decrease depending upon the number of colors, i.e. here four colors are referred to, thus, there are four developer housings.) The first developer apparatus 42 comprises a housing containing a donor roll 47, a magnetic roller 48, and developer material 46. The second developer apparatus 40 comprises a housing containing a donor roll 43, a magnetic roller 44, and developer material 45. The third developer apparatus 34 comprises a housing containing a donor roll 37, a magnetic roller 38, and developer material 39. The fourth developer apparatus 32 comprises a housing containing a donor roll 35, a magnetic roller 36, and developer material 33. The magnetic rollers 36, 38, 44, and 48 develop toner onto donor rolls 35, 37, 43 and 47, respectively. The donor rolls 35, 37, 43, and 47 then develop the toner onto the imaging surface 11. It is noted that development housings 32, 34, 40, 42, and any subsequent development housings must be scavengeless so as not to disturb the image formed by the previous development apparatus. All four housings contain developer material 33, 39, 45, 46 of selected colors. Electrical biasing is accomplished via power supply 41, electrically connected to developer apparatuses 32, 34, 40 and 42.

Sheets of substrate or support material 58 are advanced to transfer D from a supply tray, not shown. Sheets are fed from the tray by a sheet feeder, also not shown, and advanced to transfer D through a corona charging device 60. After transfer, the sheet continues to move in the direction of arrow 62, to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet.

After fusing, copy sheets are directed to a catch tray, not shown, or a finishing station for binding, stapling, collating, etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually. Residual toner and debris remaining on photoreceptor belt 10 after each copy is made, may be removed at cleaning station F with a brush or other type of cleaning system 70, after the particles are charged by the preclean corotron 96. The cleaning system is supported under the photoreceptive belt by two backers 160 and 170.

Figure 1:
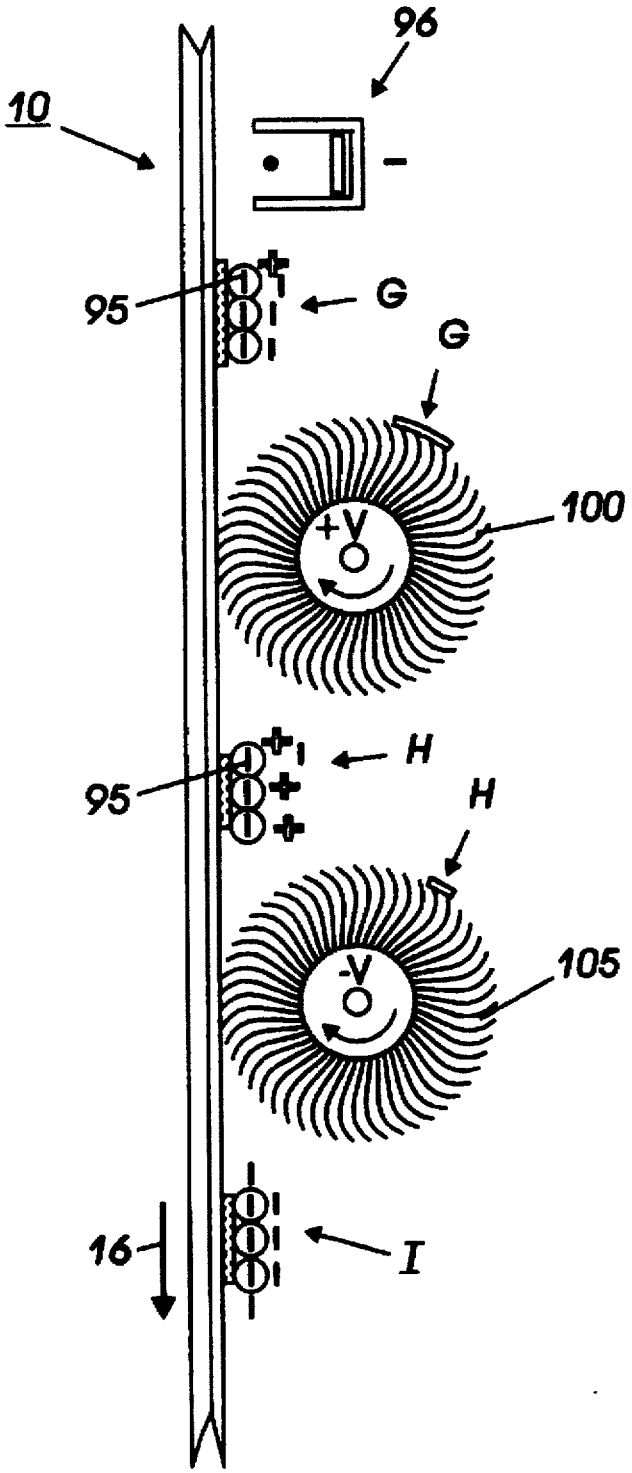
PRIOR ART FIG. 1
FIG. 1 is a schematic illustration of the prior art.

Reference is now made to FIG. 1, which shows the conventional brush bias polarity for a DESB (i.e., dual electrostatic brush) cleaner to remove residual triboelectric negative toner particles from an imaging surface. A negative preclean corotron 96 provides negative charge to the residual triboelectric negative toner particles 95 remaining on the photoreceptor 10 (e.g. imaging surface) after transfer. The residual toner particle patch G carries predominantly a high negative charge after preclean (although a small amount of low positive charge is present). The triboelectric negative toner particles accept negative charge from the negative preclean. This is an inherent toner characteristic that allows the triboelectric negative toner particles to have a high negative charge value in the G toner patch. Thus, first cleaner brush 100, in the direction of motion (shown by arrow 16) of the photoreceptor 10, is positively biased to attract the predominantly negatively charged toner particles G from the photoreceptor 10. The positively biased first brush 100 removes a substantial portion of the toner patch G that is later detoned from the brush 100. However, a small portion of the patch G is often not cleaned by the first brush 100, (i.e. a small portion passes under the brush 100 and a small amount may be redeposited from the brush 100 onto the photoreceptor 10) and remains on the photoreceptor 10, after the first brush 100, as a toner patch H. The residual patch H of triboelectric toner 95 is predominantly positively charged after contact with the positively biased brush 100.

With continuing reference to FIG. 1, the second brush 105, in the direction of motion (shown by arrow 16) of the photoreceptor 10, is negatively biased. Some of patch H is removed by the second brush 105, due to the positive charge on the triboelectric negative particles 95. However, residual toner patch I remains after the second brush cleaner 105 because of the inherent negativity of the triboelectric particles 95 which accept negative charge from the negatively biased brush. This creates highly charged negative particles, which the second negatively biased brush cannot clean. Hence, this conventional cleaning system does not clean the imaging surface of residual particles that are triboelectrically negative. The present invention provides efficient cleaning of the triboelectrically negative toner particles that are being used with increasing frequency in printer and copier applications.

Figure 2:
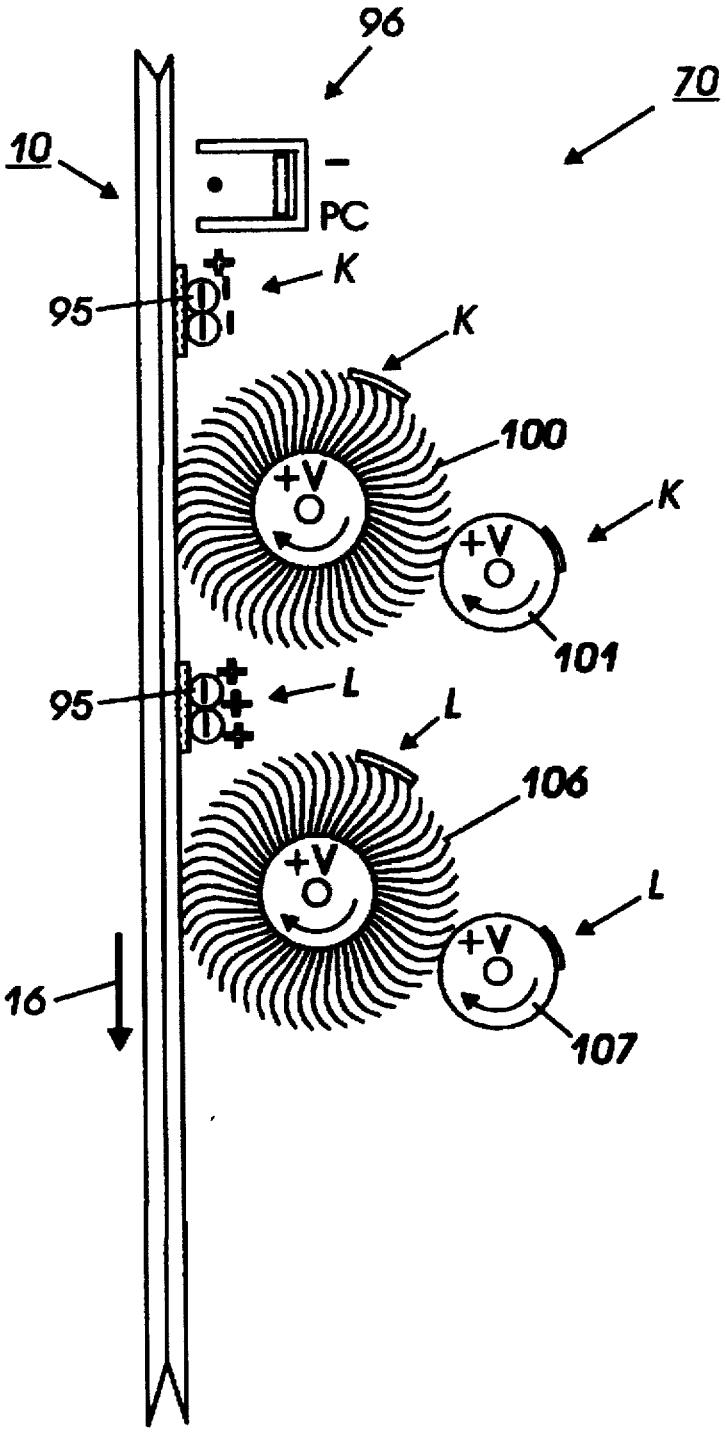
FIG. 2 is a schematic illustration of another embodiment of the present invention.

Reference is now made to FIG. 2, which shows the preferred embodiment of the present invention using dual electrostatic cleaner brushes. The residual toner patch K of charged triboelectric negative toner particles 95 is negatively charged by the negative preclean 96. The first brush 100, in the direction of motion, shown by arrow 16, of the photoreceptor 10, is positively biased to remove the negatively charged residual patch K from the photoreceptor 10. Toner patch K is detoned from the brush 100 by a detoning roll 101. (Other means of detoning not shown include air detoning and flicker bars.) The toner particles not removed by the first positively biased cleaner brush 100, on the photoreceptor 10, are shown by toner patch L. The positively biased first brush 100 cleans the positive charge triboelectric negative toner particles 95 in the toner patch L. The second brush 106 in the direction of motion of the photoreceptor 10, shown by arrow 16, is also positively biased. The second positively biased brush 106 removes the toner patch L from the photoreceptor 10. The toner patch L is then removed from the second brush 106 by a detoning roll 107. The positively charged toner patch L is removed from the photoreceptor 10 by the positively biased second brush 106 because of the following reasons: 1) the toner particles 95 are triboelectrically negative and the positive brush has an affinity for the toner, even though the particles have some positive charge; and 2) enough brush fiber strikes are sufficient to remove the toner from the photoreceptor. For example, it has been shown through experimentation, that a single brush with 18 fiber strikes cleans the residual toner off the photoreceptor, after transfer, in a printer or copier. Thus, with two brushes, each brush need only have nine fiber strikes to clean the toner off the photoreceptor. The toner mass density of the residual particles that the second brush is required to clean is very light, while the mass of this toner cannot be measured, the particles can be counted. Typically, the number of particles in the L patch range from 100 to 1000 particles per $mm^2$. The second brush 106 easily cleans this light toner density. These particles have to be cleaned because the requirement for the cleaner is less than 30 particles per $mm^2$.

In the present invention the +/+ (i.e., positive, positive) bias of the dual brush cleaner prevents the cleaning failures associated with the phenomenon of charge injection (+/− biased cleaners). The present invention is based upon the affinity that negative triboelectric toners have for positively biased conductive brushes, and also on providing sufficient fiber strikes for the second brush to clean the residual toner patch L.

In the present invention, it was determined experimentally that the correct brush polarity for negative triboelectric toner 95 and a negative preclean corotron 96, for a dual ESB (i.e. electrostatic brush) or conductive cleaner is +/+, i.e. both brushes are positively biased. The reason that the correct polarity to use for a dual cleaner system is +/+ (i.e. both positively biased) is because in a +/− cleaner system (i.e. the first cleaner, in the direction of motion, is positively biased and the second cleaner, in the direction of motion, is negatively biased) will not clean when the first positive cleaner does not clean all the toner from the photoreceptor 10. (See FIG. 1).

Referring again to FIG. 1, the reason a negatively biased second brush 105 does not clean the toner particles 95 that are not removed by the positive first brush 100 is due to the charge injection phenomenon. (The charge injection phenomenon is explained in co-pending application Ser. No. 08/622,980, filed concurrently herewith, the disclosure of which is totally incorporated herein by reference.) The negatively biased brush 105 injects or transfers negative charge to the triboelectric negative toner 95. To state this another way, due to charge injection a negatively biased brush 105 injects negative charge into triboelectric negative toner 95, and a positively biased brush 100 does not inject charge into negative triboelectric toner 95. Thus, any triboelectric negative toner 95 reaching the second negatively biased brush 105 is charged more negative (see patch I) and is repelled rather then attracted to (i.e. cleaned by) the negatively biased brush 105.

However, a positively biased brush can clean positively charged triboelectric toner. Laboratory experimentation showed that dual positive cleaner brushes 100 and 106, as shown in FIG. 2, clean toner charges in the Q/D range from about −1.7 to +0.45 fc/micron (where Q is the charge of the particle, D is the diameter of a particle and the height of a distribution represents the number of particles that have a charge Q/D). And, additionally, after transfer the positive toner Q/D does not exceed about +0.5 fc/micron. The reason that positive Q/D values greater than 0.5 fc/micron are not found is because the triboelectric negative toner does not readily accept positive charge. The triboelectric negative toner prefers to remain negative or become even more negative. Therefore, the positive charge on the triboelectric negative toner does not have a high positive value, and cleaning this toner is feasible with a positive brush with sufficient fiber strikes. Further note that after preclean, the transfer toner charge distribution is shifted more negative making the toner charge more ideal for attraction to the dual positively charged (i.e. +, +) cleaner brushes. After the preclean treatment, the positive Q/D value is about 0.2 fc/micron. (For comparison, a high negative charge value, after a negative preclean, has a Q/D of about −1.5 fc/micron.)

Figure 3:
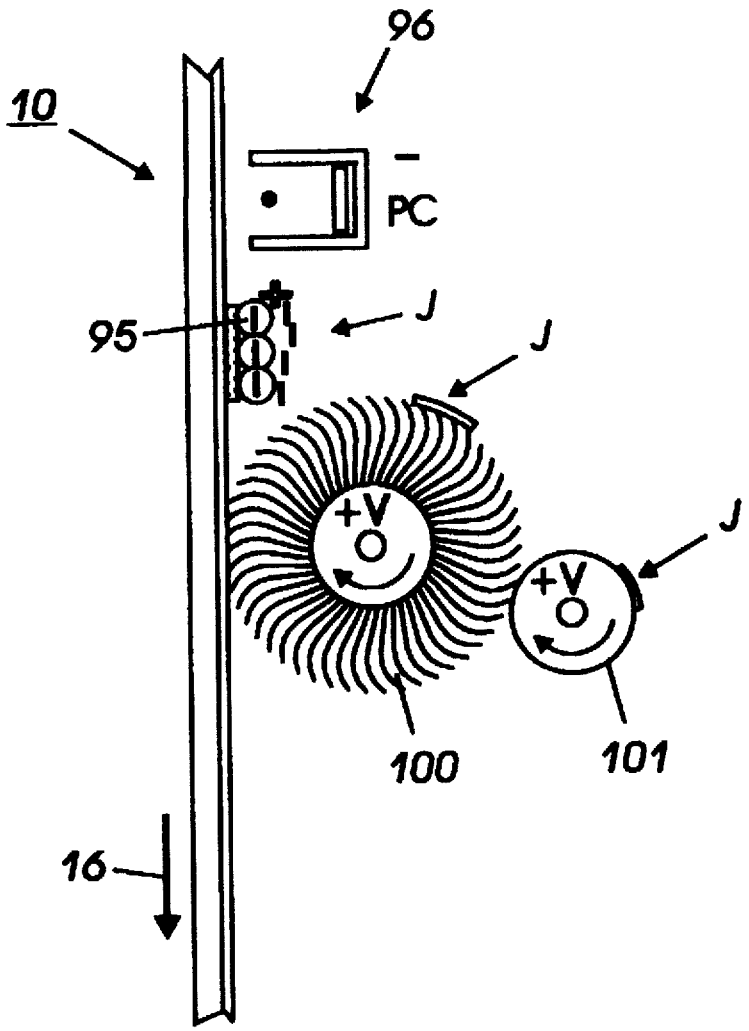
FIG. 3 is a schematic illustration of an embodiment of the present invention using a single positively biased brush.

Reference is now made to FIG. 3, which shows an alternate embodiment of the present invention using a single positively biased cleaner brush. A single positively biased brush 100, rather than a dual ESB, can be used to clean the negative triboelectric toner particles 95, shown in patch J, remaining on the surface of the photoreceptor 10 after transfer. However, more brush fiber strikes are required to clean the photoreceptor 10. Approximately 18 fiber strikes are required with a single positively biased brush 100 for efficient cleaning. In a dual brush cleaner system as shown in FIG. 2, only about nine fiber strikes for each brush is required. The fiber strikes are proportional to the brush rpm and the weave density of the brush. These parameters are selected according to the cleaning application. The use of a single positively biased brush 100, in this manner, further eliminates complicated camming mechanisms normally required for dual brush cleaners in multipass color printing operations.

With continuing reference to FIG. 3, the patch of toner particles J are negatively charged by the negatively biased preclean corotron 96. The positively biased cleaner brush 100 efficiently cleans the toner patch J from the surface because the brush 100 rpms or weave density is increased so that the number of fiber strikes for the single brush equal approximately the fiber strikes for the dual brush cleaner. A detoning roll 101 (or other detoning device) removes the toner patch J from the brush 100. The detoned toner patch is augered or directed toward a waste container (not shown).

In recapitulation, the present invention in the preferred embodiment of the dual brush cleaner, utilizes several inherent properties of triboelectric negative toners. First, negative triboelectric toner has a strong affinity for accepting negative charge. Thus, the residual toner after transfer is charged negatively with a negative preclean corotron. This creates a negative toner charge distribution that is essentially all negative and makes cleaning performance of the first brush nearly 100%. Secondly, triboelectric negative toner does not accept positive charge. Thus, the Q/D value for positive toner is low. Since the cleaning efficiency of the first brush is high, and the toner mass density after the first brush is low, the positive Q/D for this toner is low. Therefore, the fiber strikes required for the second brush are selected to clean this toner after the first brush. Usually, about nine fiber strikes are sufficient to clean the residual toner after the first brush. Finally, the negative triboelectric toner, even though this toner may be positively charged, has an affinity for the positive brush. Hence, in the alternate embodiment of this invention (i.e. the single positive brush cleaner), effective cleaning is obtained by providing sufficient fiber strikes to clean. About 18 fiber strikes are required to clean the typical toner mass densities after transfer with a single positive brush.

It is, therefore, apparent that there has been provided in accordance with the present invention, positive biasing of the dual electrostatic brushes with a negative preclean corotron for negatively charged triboelectric toner that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for removing charged triboelectric negative particles from a surface, the surface being capable of movement, comprising:

a preclean corotron having a first bias of negative charge; and a first cleaning means comprising a first conductive brush for cleaning the charged triboelectric negative particles from the surface, having a second bias different from said first bias of said preclean corotron;

a second means of cleaning the charged triboelectric negative particles from the surface, having said second bias, said second cleaning means being located downstream from said first cleaning means, in the direction of motion of the surface; and a housing, said first cleaning means and said second cleaning means being partially enclosed therein.

2. An apparatus as recited in claim 1, wherein said second cleaning means comprises a second brush.

3. An apparatus as recited in claim 2, wherein said second brush is conductive.

4. An apparatus as recited in claim 3, wherein said second bias comprises a positive charge.

5. An apparatus as recited in claim 4, wherein said first brush and said second brush, both being positively biased, contact the surface to remove the particles therefrom.

6. An apparatus as recited in claim 5, wherein said first brush being positively charged, removes the charged triboelectric negative particles having predominantly negative charge from the surface.

7. An apparatus as recited in claim 6, wherein said second brush, being positively charged, removes the charged triboelectric negative particles having predominantly positive charge from the surface.

8. An apparatus as recited in claim 7, wherein said first brush comprises a first rotational speed enabling about nine fiber strikes to remove the particles from the surface.

9. An apparatus as recited in claim 8, wherein said second brush comprises a second rotational speed enabling about nine fiber strikes to remove the particles from the surface.

10. A method for cleaning charged triboelectric negative particles from a moving surface, comprising:

transferring an image to a print medium;

charging the particles remaining after transfer, on the surface, using a negatively charged corotron;

charging a first brush positively to remove both the charged triboelectric negative particles having negative charge and the charged triboelectric negative charged particles having positive charge that remain on the surface after transfer as the first brush contacts the surface; and charging a second brush positively, in the same manner as the first brush, to remove both the charged triboelectric negative particles having negative charge and the charged triboelectric negative charged particles having positive charge that remain on the surface after transfer as the first brush contacts the surface, the second brush being located downstream from the first brush in a direction of motion of the surface.

* * * * *